United States Patent [19]

Lipp et al.

[11] 4,058,907

[45] Nov. 22, 1977

[54] DEVICE FOR THE HEAT TREATMENT OF BULK MATERIAL

[75] Inventors: Eberhard Lipp, Paderborn; Hans-Hermann Jurgens, Schloss Neuhaus, both of Germany

[73] Assignee: Firma Gebr. Lodige Maschinenbau-Gesellschaft mbH, Paderborn, Germany

[21] Appl. No.: 625,010

[22] Filed: Oct. 22, 1975

[30] Foreign Application Priority Data

Nov. 15, 1974 Germany ..... 2454208

[51] Int. Cl.[2] ..... F26B 17/20

[52] U.S. Cl. ..... 34/61; 165/109

[58] Field of Search ..... 34/60, 61; 165/109; 432/114, 118

[56] References Cited

U.S. PATENT DOCUMENTS

| | | | |
|---|---|---|---|
| 3,187,802 | 6/1965 | Hickey | 165/109 X |
| 3,360,865 | 1/1968 | Galle et al. | 34/60 X |

FOREIGN PATENT DOCUMENTS

| | | | |
|---|---|---|---|
| 43,770 | 8/1938 | Netherlands | 165/109 |

*Primary Examiner*—Alan Cohan
*Assistant Examiner*—Gerald A. Michalsky
*Attorney, Agent, or Firm*—Donald D. Jeffery

[57] ABSTRACT

A device for the heat treatment of bulk material comprising a horizontal trough-shaped container having a driven shaft extending longitudinally therethrough on which shaft are mounted radially extending arms on which are provided mixing tools and heat exchange plates removably suspended in the container between the mixing tools. A heating or cooling medium can be passed through the plates to heat or cool the bulk material.

14 Claims, 2 Drawing Figures

DEVICE FOR THE HEAT TREATMENT OF BULK MATERIAL

BACKGROUND OF THE INVENTION

1. Field of the Invention

The invention relates to a device for the heat treatment of bulk material, such as a dryer or a cooling or heating apparatus.

2. Description of the Prior Art

Bulb material dryers are known which have a drum-shaped container with a horizontal longitudinal axis, in which there is centrally mounted a driven shaft which is provided with mixing tools on radial arms, and in which discs are arranged on the shaft concentric to the container which can be heated through the shaft and which rotate with it. These discs have the disadvantage that the dryer is practically inaccessible for servicing operations. Repairs to the heatable discs can only be conducted if the shaft together with the heating elements mounted upon it, namely the discs is removed from the container. The available heating surface cannot in practice be altered, because with simple means it is not possible to change the number of heating discs, i.e. to incorporate additional heating discs or to remove a few of the heating discs. Moreover the temperature of the heating discs cannot regulated individually, so that there is a danger, especially with a continuously operated dryer that when the drying is almost complete products will be overheated and will thus suffer damage. Furthermore the disc-shaped heating elements rotating with the shaft prevent the incorporation of further mixing elements, such as cutter heads, in the region of the rotating discs on the wall of the container.

In order to remove vapours or other moisture released from the bulk material gas flows axially through the dryer container. In the case of long large dryers such high flow rates are generated that product particles are entrained in the flow and so the moisture-removing gas must be passed through a separator. In addition the gas temperature cannot be adjusted over the length of the dryer to suit requirements and cannot be adapted to the requirements of the particular product.

SUMMARY OF THE INVENTION

The object of the invention therefore is to provide a device for the heat treatment of all kinds of bulk materials, which in the smallest space enables the application of heat to the bulk material to be regulated according to operational requirements, and in particular to be adapted to the requirements of varying products and/or methods of treatment without special provisions having to be made in order to prevent a loss of solid particles entrained in the gas removing the moisture released.

In order to achieve this object, it is proposed that, in a device for the heat treatment of bulk material comprising a horizontal trough-shaped container having a driven shaft extending longitudinally therethrough on which shaft are mounted radially extending arms on which are provided mixing tools there are provided heat exchange plates removably suspended in the container between the mixing tools.

The heating plates should be adapted to the inside cross-section of the container. The result of this material in the container has to come in to contact with the heating plates. Each heating plate is provided with a cut out, so that it will avoid the fittings of the dryer such as the shaft of the paddle conveyor and any cutter heads which may be present on the wall of the container, and in addition to provide a controllable material transport system through the dryer which is particularly useful in continuous operation.

By being able to suspend more or fewer heating plates individually in the container which should preferably have a double skin for conveying a heating medium it is possible firstly to achieve the maximum heat exchange surface in the minimum space and secondly to adjust a smaller heat exchange surface for other requirements, as necessary. Such a device permits an adjustable temperature range over its length, in which the heating plates can be connected individually or in groups to a heat source, in such a way that the temperature of each heating plate or of each group of heating plates can deviate from the temperatures of other heating plates or other groups of heating plates as necessary. Thus, for example at the input end of the device one can apply a high degree of heating to the still very damp material whereas near the output end of the container where a material is already relatively dry a smaller amount of heat is transferred to the material in order to effect the necessary drying without the danger of product damage. The surface area used in the heat exchange can be increased by selecting the number of heating plates in such a way that the heating surface of the heating plates constitutes more than 100% of the surface of the heated side wall of the dryer container.

Using the device according to the invention damp and even pulpy bulk material and suspensions can be continuously or discontinuously dried, cooled or heated under reduced pressure, normal pressure or slightly increased pressure. The material to be treated is constantly loosened up by means of the rotating tools and provision is made to remove the moisture released from the material from the dryer.

There are great advantages for the maintenance of the device according to the invention. The whole outline of the container is available for access, as the container is designed in the form of a trough and its side walls extend vertically upwards above the semicircular lower part so that the heating plates can be taken out of the container without the necessity of removing the shaft on which the tools are mounted or any other fittings. Since the shaft is provided with individual tools of simple construction heating plates can also be built into the container or subsequently taken out of the dryer at little expense. For easy installation and dismantling and for fixing the heating plates in the desired position, according to a further feature of the invention vertical guides are provided on the side walls of the container, into which the heating plates can be inserted from above. These rails should preferably be secured to the side walls of the container by means of screws so that the guides can be moved and then attached in the desired positions and the heating plates can be installed in the container in the position and number required. The latter are designed so that they do not in any way hinder the rotating tools of the shovel conveyor or any other fittings. The heating plates should be lightly fixed to their guides or mountings, for example by means of screws. Thus they will not be loosened or shifted by the vibrations occurring during the operation of the device.

The heat exchange plates should be constructed with double walls and each provided with one inlet and one outlet for a heating medium, such as steam or hot water or a cooling medium to flow through them. But heating by means of electricity or any other heating medium is also conceivable.

If the heating medium is steam or hot water, the double skin of the trough-shaped container and the heating plates can be supplied with heating medium by one and the same heating source. However it is conceivable to regulate the temperature of the heating medium flowing into the individual heating plates without there being any necessity for different heating devices. For example, the heating medium which is passed through heating plates located near the inlet end of the dryer and which has already given off a part of its heat there, can then flow through the heating plates which lie further back in the direction of running through the dryer and can there give off further heat. As the temperature difference between the heating medium and the material to be treated is lower at this point there is no overheating or overcooling of the material, so that product damage is impossible. On the contrary this provides a product-protecting treatment. Although the heating plates are provided with cut-outs, which make it possible to suspend the heating plates above the shaft and additional fittings such as cutter-heads, optionally located in the side wall of the container, only a small part of the heating surface is lost because of these substantially cap-shaped cut-outs. On the contrary there is the advantage that the material to be treated on passing through the device passes both over and under the heating plates and thus also moves into the range of activity of the cutter heads, which break up agglomerations of the material better or even entirely eliminate them. p According to a further feature of the invention a gas is passed through the container of the device in zones in a transverse direction, its temperature being adjustable in different zones over the length of the container, so that it can be adapted to the particular temperature of the product. This gas removes the moisture released i.e. vapourised or evaporated from the material by the influence of heat. Because the gas passes through the container not in the longitudinal direction but in the transverse direction for a given gas-flow quantity its flow rate is significantly lower than if the gas passed through the container in the longitudinal direction so that it carries no solid particles with it and thus does not have to be passed through a separator for solid particles.

DESCRIPTION OF THE PREFERRED EMBODIMENT

Figure 1:
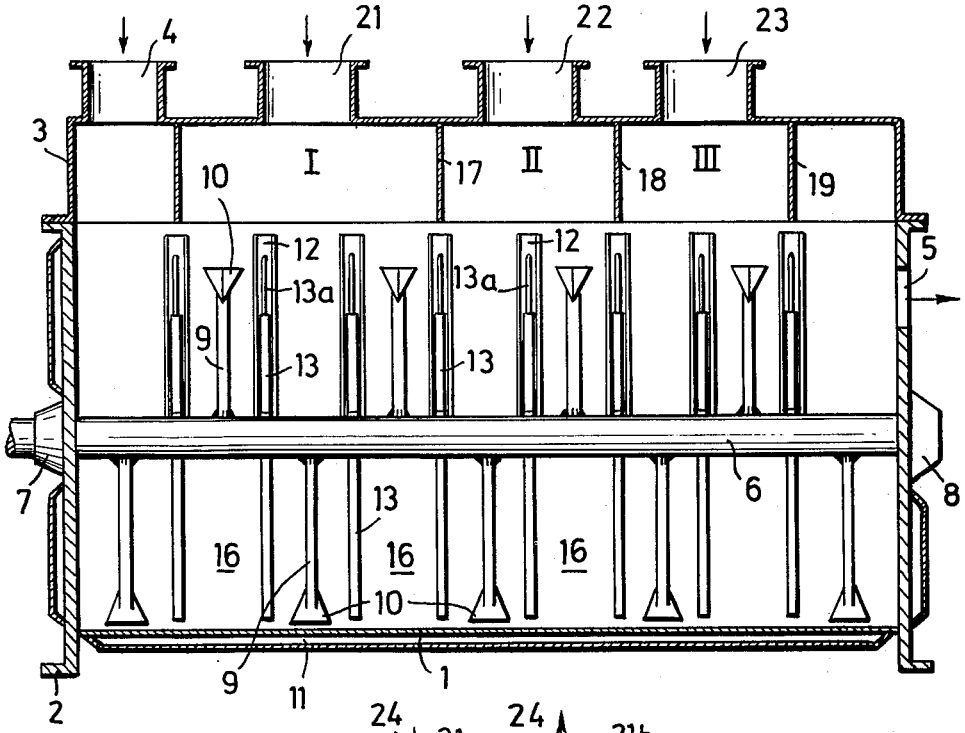
FIG. 1 shows a longitudinal section through an embodiment of the dryer according to the invention.

The dryer consists of a container 1, comprising a trough 2 and a cowl 3. A closable inlet opening 4 is provided at one end of the dryer in the cowl 3, and at the other end of the dryer, in the trough 2, a closable outlet opening 5 is provided. Depending on whether the dryer is being operated discontinuously or continuously, these openings can be kept open or closed during operation.

The cowl 3 is mounted detachably on the bucket-shaped trough 2 and seals it. A shaft 6 is rotatably mounted in the container 1 in front-mounted bearings 7 and 8, which shaft can be driven by a drive mechanism which is not shown. A plurality of radial arms 9 are fitted to the shaft, having mixing tools 10 attached to their extremities.

The container 1 is provided with a double skin 11, through which a heating medium, such as steam or hot water can be passed. Guide surfaces for the heating medium can be fitted inside the double skin 11.

In the vertical upper region of the trough a number of pairs of vertical guide rails 12 are attached to the inside walls to receive heating plates 13. Each heating plate 13 is fitted with an inlet pipe **13*a* and an outlet pipe 13*b* for the heating medium. The heating plates 13 are each arranged between two neighbouring mixing tools 10, as shown in FIG. 1. Each heating plate is adapted to the internal cross-section of the trough 2 and has a cut-out 14, to enable it to be suspended above the shaft 6 and optionally also above the fittings 15 located in the side wall of the container 1, being fitted for example with the cutter head. The cut-outs 14 also enable the material to be treated to pass from the front to the rear end of the container, so that this material can not only pass over the plate 13, but also through them from one chamber 16 into the next. Each two adjacent heating plates 13 thus delineate a chamber 16 in the container 1** which serves as a dryer chamber.

Figure 2:
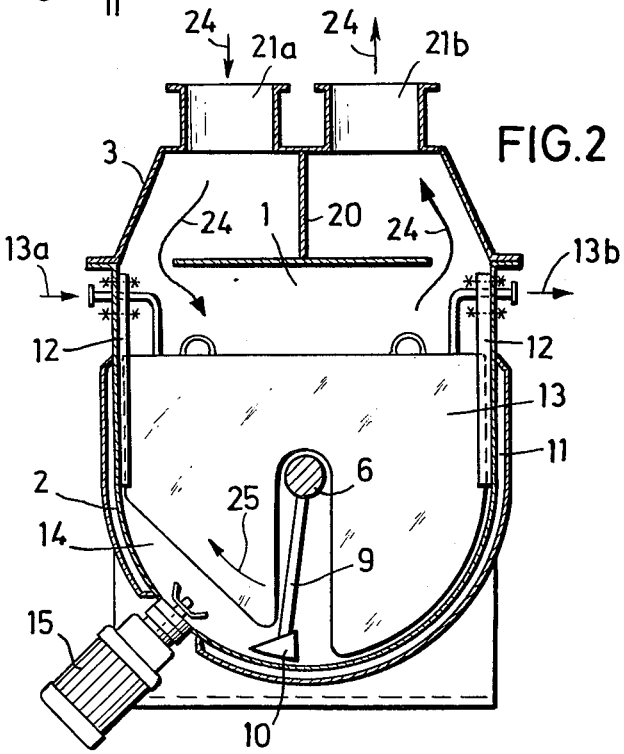
FIG. 2 shows a cross-section through the dryer shown in FIG. 1.

The heating plates 13 are preferably suspended in the manner shown in FIG. 2, so that their cut-outs 14 are located in the parts of the container 1 in which the rotating mixing tools 10 lift up the bulk material to be dried. The result of this is that the bulk material passes through the individual heating chambers. However, to alter the speed of the bulk material passing through the dryer, the heating plates can also be suspended inverted.

It is evident that one should not suspend a heating plate 13 between two neighbouring arms 9. The number of heating plates can be adapted to the particular operating conditions within wide limits. Cross plates 17, 18 and 19 divide the cowl 3 into several axial zones (in the embodiment shown three zones I, II and III) which are each subdivided longitudinally by web plates 20. Above each zone there is located a pair of nozzles 21, 22, 23, one nozzle (a) of each pair being used as a drying air inlet and the other (b) being used for removing the drying air.

The longitudinal and horizontal division of the cowl 3, in connection with the division of the trough 2 effected by the heating plates 13 facilitates an air cross flow. In the embodiment shown, the transverse movement of air in zone I extends through three chambers 16 delineated by heating plates 13, and in zones II and III in each case through two chambers. To create more cross-ventilation zones, more cross plates 17, 18, 19 should be provided accordingly, with the appropriate nozzles in each case. The maximum number is reached when one cross plate 18, 19 is located above each heating plate 13. According to requirements, the drying air can be led to the material moved in the direction of the arrow 25 by means of the shovel-like mixing tools 10 in counterflow (as indicated by arrows 24) or in parallel flow.

The dryer according to the invention facilitates rapid and intensive drying of all kinds of bulk materials without the danger of the material being overheated or suffering any other damage.

Although the invention has been described using the example of a dryer it is not limited to such a device. On the contrary it can be applied to all devices, with which bulk materials can be heated, cooled or subjected to any other heating or cooling treatments.

We claim:

1. Apparatus for the heat treatment of bulk material, comprising: a generally horizontally extending trough-shaped container; a driven shaft extending longitudinally through and being mounted for rotation with respect to said container; a plurality of arms operatively secured to and extending generally radially outwardly from said shaft for rotation therewith, said arms having means for mixing bulk material within said container; a plurality of separate heat exchanger plates positioned within said container between said radially extending arms, and means mounted on side walls of said container for mounting each of said plates so that each plate is individually removable independently of each other and of said shaft, the cross-sectional configuration of said heat exchanger plates generally conforming to the internal configuration of said trough-shaped container, with each plate being formed with cutouts aligned with interfering parts within said container, including said shaft.

2. The heat exchange apparatus according to claim 1, where each of said heat exchanger plates includes means for transferring heat directly to and from said heat exchanger plates independently of said shaft and the bulk material within said container, which means for transferring heat includes energy source inlet and outlet coupling means outside of said container and separately for each of said plates.

3. The heat exchange apparatus according to claim 2, wherein the energy source inlet coupling means for each heat exchanger plate extends through the opposite side of said container from the energy source outlet coupling means.

4. The heat exchange apparatus of claim 1, wherein said means for mounting each of said plates comprise pairs of transversely opposed, generally vertically extending guide rails mounted on said side walls interengaging with respective heat exchange plates for permitting individual vertical assembly and removal of said heat exchanger plates while preventing axial movement, with respect to said shaft, of said heat exchanger plates within said container, said guide rails suspending each of said plates from the bottom of said container.

5. The heat exchange apparatus according to claim 1, wherein each of said heat exchanger plates is generally hollow throughout its extent and of double wall construction with inlet pipe means and outlet pipe means.

6. The heat exchange apparatus according to claim 5, wherein said container is generally constructed of double wall thickness to provide an internal hollow construction for the receipt of heat exchange fluid separately from and out of direct fluid communication with the hollow interior of said heat exchange plates.

7. A heat exchange apparatus for the heat treatment of bulk material, comprising: a generally horizontally extending trough-shaped container; a driven shaft extending longitudinally through and being mounted for rotation with respect to said container; a plurality of arms extending generally radially outwardly from said shaft and having means for mixing bulk material within said container during rotation of said shaft; a plurality of heat exchanger plates separately mounted within said container between said radially extending arms so as to be individually removable independently of each other and said shaft, a hood generally closing the upper portion of said trough-shaped container and having therein at least one inlet and one outlet for process gas, said hood being provided with flow control means for directing the process gas from said inlet in a generally transverse path through said container to said outlet.

8. The heat exchange apparatus according to claim 7, including a plurality of said inlets, said outlets, and flow control means in groupings such that there are chambers formed by transversely aligned flow control means and heat exchanger plates axially in succession throughout said container.

9. The heat exchange apparatus according to claim 8, wherein each of said exchanger plates includes a peripheral wall portion spaced from an adjacent portion of the bottom of said trough-shaped container a distance to provide an axial flow passage from one chamber to another chamber for the bulk material, with the flow passage from bulk material of each heat exchanger plate being generally axially aligned with the flow passage of the adjacent heat exchanger plate.

10. The heat exchange apparatus according to claim 9, wherein said flow control means includes, for each pair of inlets and outlets, a substantially axially and vertically extending partition between the paired inlet and outlet for guiding the process gas downwardly into said container, and generally horizontally extending partitions for guiding the process gas transversely towards the side walls of said container.

11. The heat exchange apparatus according to claim 8, wherein said flow control means includes, for each pair of inlets and outlets, a substantially axially and vertically extending partition between the paired inlet and outlet for guiding the process gas downwardly into said container, and generally horizontally extending partitions for guiding the process gas transversely towards the side walls of said container.

12. The heat exchange apparatus according to claim 7, wherein said flow control means includes, for each pair of inlets and outlets, a substantially axially and vertically extending partition between the paired inlet and outlet for guiding the process gas downwardly into said container, and generally horizontally extending partitions for guiding the process gas transversely towards the side walls of said container.

13. The heat exchange apparatus according to claim 7, including an inlet means for the bulk material at one axial end of said container and outlet means for the bulk material at the opposite axial end of said container for providing axial flow of bulk material through the entire container.

14. A heat exchange apparatus for the heat treatment of bulk material, comprising: a generally horizontally extending trough-shaped container; a driven shaft extending longitudinally through and being mounted for rotation with respect to said container; a plurality of arms extending generally radially outwardly from said shaft and having means for mixing bulk material within said container during rotation of said shaft; a plurality of heat exchanger plates separately mounted within said container between said radially extending arms so as to be individually removable independently of each other and said shaft, wherein said container has generally vertically extending side walls and a bottom, and each of said heat exchanger plates includes generally vertically extending peripheral side walls closely adjacent said vertically extending walls of said container, a slot extending from the bottom upwardly to immediately above said shaft to facilitate assembly without removal of said shaft, and lower remaining peripheral wall portions adjacent the container bottom and including a cut out portion providing an axial flow passage for bulk material, and a mechanical mixing head extending through said container into the bulk material axial flow passage radially opposite an adjacent heat exchanger plate, and power means for rotating said mixing head.

* * * * *